US006592477B1

(12) United States Patent
Yang

(10) Patent No.: US 6,592,477 B1
(45) Date of Patent: Jul. 15, 2003

(54) BALL HAVING MOLDED AND RAISED SEAM AND LEATHER COVER

(76) Inventor: Wen Hsiang Yang, No. 201, Chong Don Street, Kaohsiung (TW), 800

( * ) Notice: Subject to any disclaimer, the term of this patent is extended or adjusted under 35 U.S.C. 154(b) by 0 days.

(21) Appl. No.: 10/056,466

(22) Filed: Jan. 28, 2002

(51) Int. Cl.[7] ..... A63B 43/02
(52) U.S. Cl. ..... 473/597; 473/602
(58) Field of Search ..... 473/597, 598, 473/599, 600, 601, 602

(56) References Cited

U.S. PATENT DOCUMENTS 4,653,752 A * 3/1987 Miller ..... 473/601
4,660,830 A * 4/1987 Tomar ..... 473/601
4,729,566 A 3/1988 Molitor ..... 273/60 A
5,123,659 A * 6/1992 Williams ..... 473/601
5,704,858 A * 1/1998 Yang ..... 473/602
5,772,544 A 6/1998 Yang ..... 473/598
5,951,420 A * 9/1999 Talarico et al. ..... 473/601
6,190,273 B1 2/2001 Maxey et al. ..... 473/598
6,206,795 B1 * 3/2001 Ou ..... 473/599

* cited by examiner

*Primary Examiner*—Kien T. Nguyen

(57) ABSTRACT

A ball includes a core, and two 8-shaped leather cover pieces secured onto an outer peripheral portion of the core with such as the adhesive materials. A water-proof outer layer is formed on the outer peripheral portion of the core for protecting the core and for preventing the core from being wetted, the 8-shaped cover pieces are secured onto the outer layer. The outer layer includes an 8-shaped seam for forming two 8-shaped recesses and for receiving the cover pieces. The seam has a number of bulges for simulating the raised seam or stitches of the typical balls.

2 Claims, 3 Drawing Sheets

BALL HAVING MOLDED AND RAISED SEAM AND LEATHER COVER

BACKGROUND OF THE INVENTION

1. Field of the Invention

The present invention relates to a ball, and more particularly to a base ball or a soft ball having a molded and raised seam and having a leather covering attached to the outer peripheral portion thereof.

2. Description of the Prior Art

Typical base balls comprise a pair of 8-shaped cover pieces secured together on a core of the ball with stitches, and having a raised seam formed or provided between the 8-shaped cover pieces. U.S. Pat. No. 5,772,544 to Yang, and U.S. Pat. No. 6,190,273 B1 to Maxey et al., discloses two of the typical base balls. However, water or the like may permeate into the core of the base ball through the stitches provided between the cover pieces. In addition, the cover pieces should be secured together manually with the stitches and may not be produced in mass production.

U.S. Pat. No. 4,729,566 to Molitor discloses the other typical ball including a molded cover formed or provided on the outer peripheral portion of a molded core. However, the molded cover is made of plastic or rubber or synthetic material, that has a completely different grasping or gripping feeling for the pitchers, as compared with the real base balls that have leather cover layer provided thereon.

The present invention has arisen to mitigate and/or obviate the afore-described disadvantages of the conventional balls.

SUMMARY OF THE INVENTION

The primary objective of the present invention is to provide a ball including a molded and raised seam and including a leather covering attached to the outer peripheral portion thereof.

In accordance with one aspect of the invention, there is provided a ball comprising a core including an outer peripheral portion, and two 8-shaped cover pieces secured onto the outer peripheral portion of the core, and made of leather material. The cover pieces are preferably secured onto the core with adhesive materials.

A water-proof outer layer is further provided on the outer peripheral portion of the core for protecting the core and for preventing the core from being wetted, the 8-shaped cover pieces are secured onto the outer layer.

The outer layer includes an 8-shaped seam extended outward therefrom for forming two 8-shaped recesses therein and for receiving the 8-shaped cover pieces.

The seam includes a plurality of bulges extended radially outward therefrom for simulating the raised seam or stitches of the typical balls.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
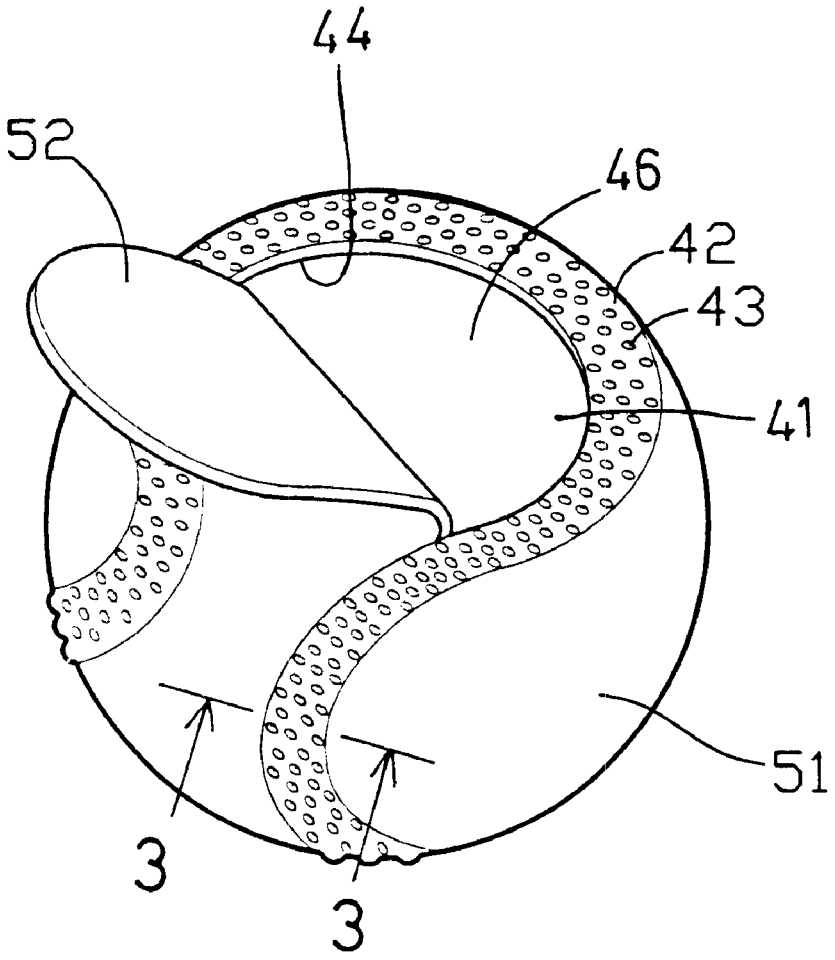
FIG. 1 is a perspective view of a ball in accordance with the present invention, in which one of the cover layers has been partially peeled off or opened.
Figure 2:
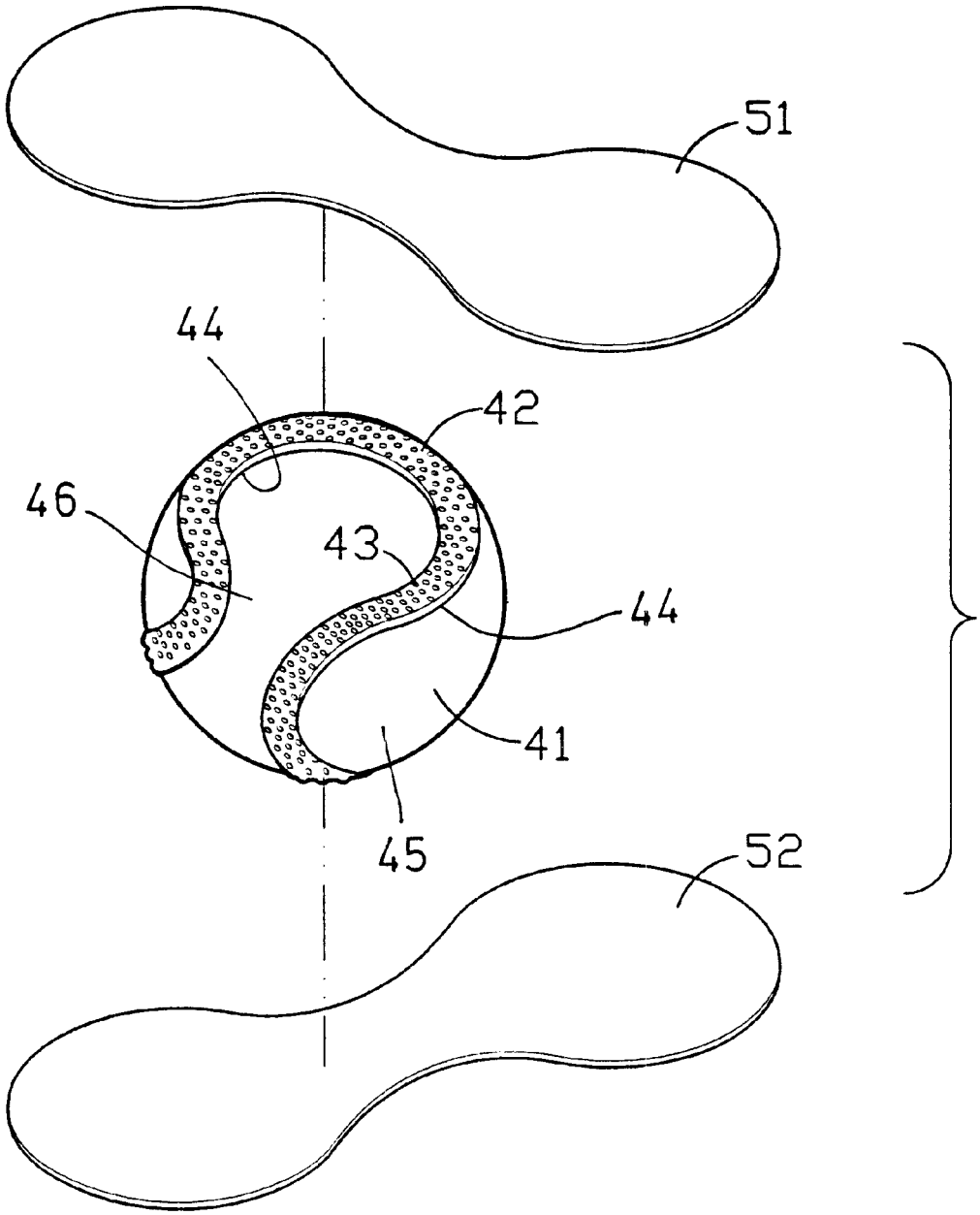
FIG. 2 is a partial exploded view of the ball.
Figure 3:
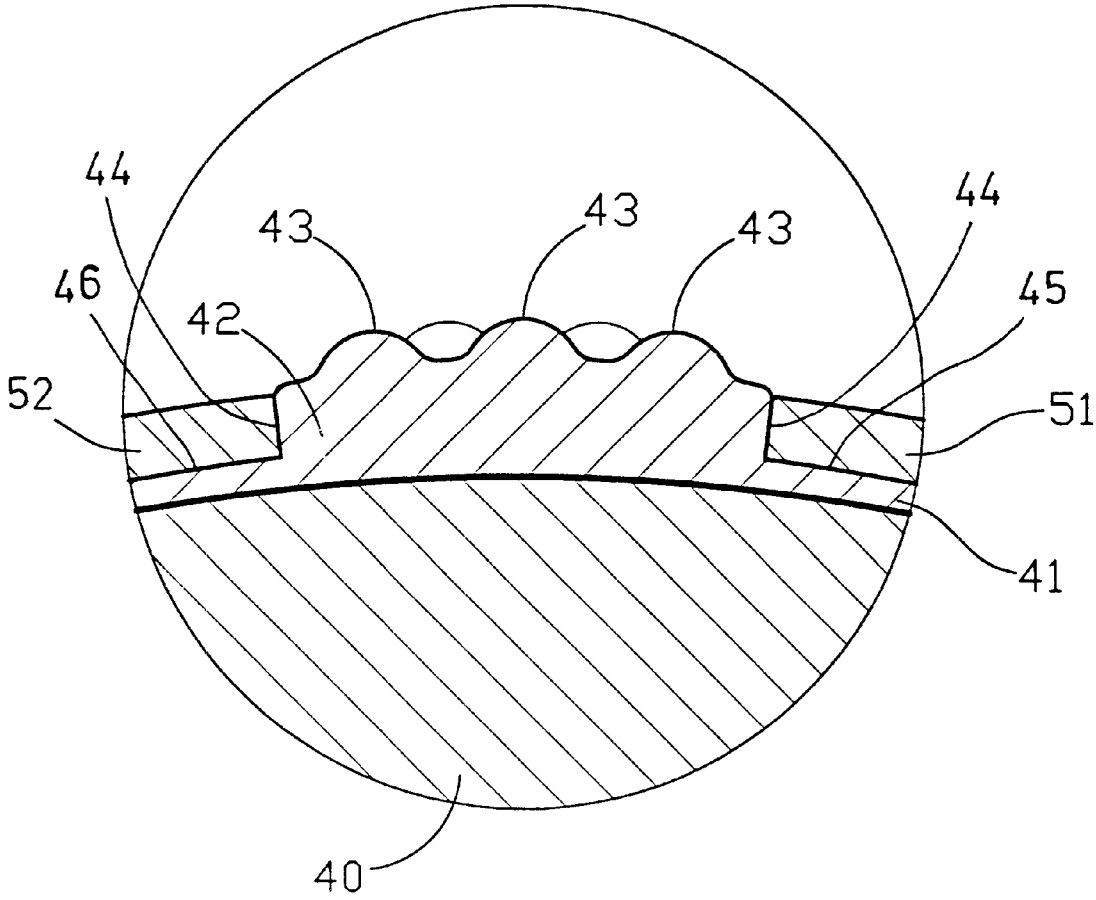
FIG. 3 is an enlarged partial cross sectional view taken along lines 3—3 of FIG. 1.

Referring to the drawings, a ball in accordance with the present invention comprises a core 40 that may be of any conventional construction, and an outer layer 41 is formed around or on the outer peripheral portion of the core 40. The outer layer 41 is preferably made by a molding or mold injection process and made with the plastic or rubber or synthetic material that is preferably water proof, for preventing water or the like from entering or permeating into the core 40 of the ball.

The ball further includes a substantially 8-shaped and raised seam 42 formed on the outer peripheral portion of the outer layer 41, and preferably formed together with the outer layer 41 during the molding or mold injection process. The seam 42 preferably includes a number of bulges 43 extended radially outward therefrom for simulating the stitches or the raised seam of the typical base balls or soft balls. The seam 42 is raised or extended from the outer layer 41 for forming or defining one or more peripheral shoulders 44 on both sides of the seam 42 or between the seam 42 and the outer layer 41; and/or for forming or defining two 8-shaped recesses 45, 46 between the seam 42 and the outer layer 41.

The ball further includes two 8-shaped cover pieces 51, 52 which are preferably made of leather products, and which are engaged into the 8-shaped recesses 45, 46 of the ball respectively, and which are secured to the outer layer 41 and/or the seam 42 with such as the adhesive materials. The cover pieces 51, 52 includes a peripheral portion engaged with the respective peripheral shoulders 44 of the ball for allowing the cover pieces 51, 52 to be solidly secured on the outer peripheral portion of the outer layer 41, and to be shielded or protected by the seam 42.

In operation, the pitchers or the ball players may solidly or effectively control the ball with the raised seam 42, and may feel comfortable to grasp or grip the leather cover pieces 51, 52. None of the typical balls include the leather cover layers secured onto the outer peripheral portion of the ball with adhesive materials without stitches.

Accordingly, the ball in accordance with the present invention includes a molded and raised seam and including a leather covering attached to the outer peripheral portion thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ball comprising:

a core including an outer peripheral portion, an outer layer provided on said outer peripheral portion of said core, and including an 8-shaped seam extended outward therefrom to form two 8-shaped recesses therein, and two 8-shaped cover pieces secured onto said outer layer, and received in said 8-shaped recesses of said outer layer, and made of leather material.

2. The ball according to claim 1, wherein said seam includes a plurality of bulges extended radially outward therefrom.

* * * * *